US007328993B2

(12) United States Patent
Van Soest et al.

(10) Patent No.: US 7,328,993 B2
(45) Date of Patent: Feb. 12, 2008

(54) PRINTER

(75) Inventors: Hendrikus J. J. Van Soest, Helden (NL); Jeroen J. G. Coenen, Venray (NL)

(73) Assignee: Océ-Technologies B.V., Venlo (NL)

( * ) Notice: Subject to any disclaimer, the term of this patent is extended or adjusted under 35 U.S.C. 154(b) by 251 days.

(21) Appl. No.: 11/269,795

(22) Filed: Nov. 9, 2005

(65) Prior Publication Data

US 2006/0103708 A1 May 18, 2006

(30) Foreign Application Priority Data

Nov. 12, 2004 (NL) ..... 1027493

(51) Int. Cl.
*B41J 2/01* (2006.01)

(52) U.S. Cl. ..... 347/104; 400/578; 400/611; 400/613

(58) Field of Classification Search ..... 347/104; 400/578, 611, 613
See application file for complete search history.

(56) References Cited

U.S. PATENT DOCUMENTS 613,178 A * 10/1898 Unz ..... 400/242
4,479,615 A * 10/1984 Nakajima et al. ..... 242/598.4
4,821,974 A * 4/1989 Poehlein ..... 242/596.4

* cited by examiner

*Primary Examiner*—Matthew Luu
*Assistant Examiner*—Justin Seo
(74) *Attorney, Agent, or Firm*—Birch, Stewart, Kolach & Birch, LLP

(57) ABSTRACT

A printer including a printhead which is displaceable at the level of a print surface in a main scanning direction and in a sub-scanning direction with respect to a substrate situated in the print surface, and a supply unit for storing the substrate which is disposed on a core and delivering the substrate for transport to the print surface, said supply unit including support means for supporting the core at its end portions so that the core, while being supported, can rotate with the unwinding of substrate from the core, said support means containing an element for exerting a force on the core in the axial direction during the rotation thereof, whereby the core is pressed against a stop which occupies a substantially fixed position in the axial direction with respect to the print surface.

9 Claims, 4 Drawing Sheets

PRINTER

BACKGROUND OF THE INVENTION

The present invention relates to a printer containing a printhead which is displaceable at the level of a print surface in a main scanning direction and in a sub-scanning direction with respect to a substrate situated in the print surface, and a supply unit for storing the substrate and delivering the substrate for transport to the print surface, which unit includes means to support a core in the vicinity of its ends, such that the core, while being supported, can rotate to unwind the substrate rolled on said core.

A printer of this kind is generally known from the prior art. In this printer, the substrate is stored on a roll, particularly a core on which 50 to 200 meters of a specific type of substrate are rolled. To print the substrate, the substrate is unwound from the core in the printer as required, and the free end is transported to the print surface. There at least a part of the image for printing is formed by moving the printhead with respect to the substrate in the main scanning direction, typically perpendicularly to the direction of transport of the substrate, and simultaneously energising the printhead imagewise. Thus a strip can be printed on the substrate in the width of the writing part of the printhead. After one or more relative movements of the printhead with respect to the substrate over the strip, the substrate is moved in the sub-scanning direction with respect to the printhead, and this is typically the direction of transport of the substrate, so that a new part of the substrate comes to lie on the print surface. Thus a following part of the image can be formed by scanning the printhead over this new part of the substrate. In this way, a part of the substrate in the size of the image for printing can be completely scanned and provided with all the sub-images. These sub-images together form the image for printing. After the image has been printed, the printed part of the substrate is often cut off from the rest of the substrate so that it can be used separately. The printhead can be equipped with one or more individually activatable print modules. A typical example is an inkjet printhead which comprises four print modules, one for each of the colors cyan, magenta, yellow and black. One problem with this known printer is the incidence of visible connection errors between the different sub-images. For example, sub-images which should just adjoin one another frequently overlap or do not have a common border over their complete length. Such faults may have a very disturbing effect on the printed image, particularly in the case of a color printer. It is known from the prior art to use print strategies to mask these faults. A disadvantage of this is that the possibilities of masking are limited and frequently it is not possible to allow for an arbitrary variation in connection errors.

SUMMARY OF THE INVENTION

The object of the present invention is to provide a printer which counteracts the above disadvantages. To this end, a printer has been developed wherein the supply unit also includes an element for exerting a force on the core in the axial direction during the rotation thereof, the core being pressed against a stop, which stop, in the axial direction, occupies substantially a fixed position with respect to the print surface.

It will be apparent that in this way many connection faults, for example faults in the main scanning direction and in the sub-scanning direction, can be prevented. Since the stop occupies a substantially fixed position in the axial direction with respect to the print surface, the core pressed against the element, and the substrate wound on the core, will also occupy substantially a fixed position with respect to the print surface, at least in the axial direction. It has been found that in this way the incidence of connection faults between the sub-images can be very considerably suppressed.

In one embodiment, the element is resilient in the said axial direction. The advantage of this is that the core can be easily placed in the supply unit between the element and the stop, while a pressure application force is at the same time provided in the axial direction.

In another embodiment, in which the support means are distributed over a first and second support member, the stop is a part of the second support member. This embodiment has the advantage that the risk of connection faults is further reduced.

In another embodiment, the supply unit comprises two elements for exerting a force on the core in the axial direction. This embodiment offers the advantage that a force can be exerted on the core on both sides of the core shaft. As a result, a greater force can be exerted in the axial direction, thus reducing the risk of inducing an oscillation of the core. This further reduces the risk of connection faults.

In another embodiment, the two elements are spaced apart by an amount substantially equal to the diameter of the core. The force can thus be exerted on the edge of the core, distributed over two opposite points on the edge. This is a simple matter of providing adequate and reliable pressing of the core against the stop. In one embodiment, the elements are resiliently mounted wheels. In this case the core can rotate freely over the wheels while they exert a force on the core in the axial direction. As a result of the possibility of free rotation, the frictional force between the elements and the core during the rotation thereof are minimised. The incidence of irregularities in the speed at which the substrate is unwound can thus be prevented.

In one embodiment, the supply unit includes a drawer containing the support means and the printer includes another element for exerting force on the drawer in a direction parallel to the core wherein the drawer is pressed against a stop, which stop in the said direction occupies substantially a fixed position with respect to the print surface. In this embodiment, a core with a substrate wound thereon can easily be placed in the supply unit by pulling out the drawer. In this way, the support means located in the drawer are exposed and are easily accessible for insertion of a new roll of substrate. After insertion, the drawer can be closed, whereupon the substrate can be unwound for transport to the print surface. Since this drawer can move with respect to the other parts of the printer, particularly the print surface, in this embodiment the drawer is pressed against a stop which occupies substantially a fixed position with respect to said print surface, at least in a direction parallel to the core. In this way, the drawer itself also occupies substantially a fixed position with respect to the print surface so that connection faults originating from uncertain positioning of the drawer with respect to the print surface can be prevented. In a further embodiment, the drawer is equipped for simultaneously holding two cores, each provided with a substrate rolled thereon.

In one embodiment the core is provided with an external toothing in the vicinity of one end of said core and the supply unit is provided with a driveable gearwheel for engaging the said toothing if the core is supported. This embodiment makes it a simple matter to drive the core for rotation, for example for unwinding or rewinding of the substrate. The support means prevent the core from being carried by the drivable gearwheel at the location of the toothing.

BRIEF DESCRIPTION OF THE DRAWINGS

The present invention will now be explained further with reference to the following drawings, wherein.

DETAILED DESCRIPTION OF THE INVENTION

Figure 1:
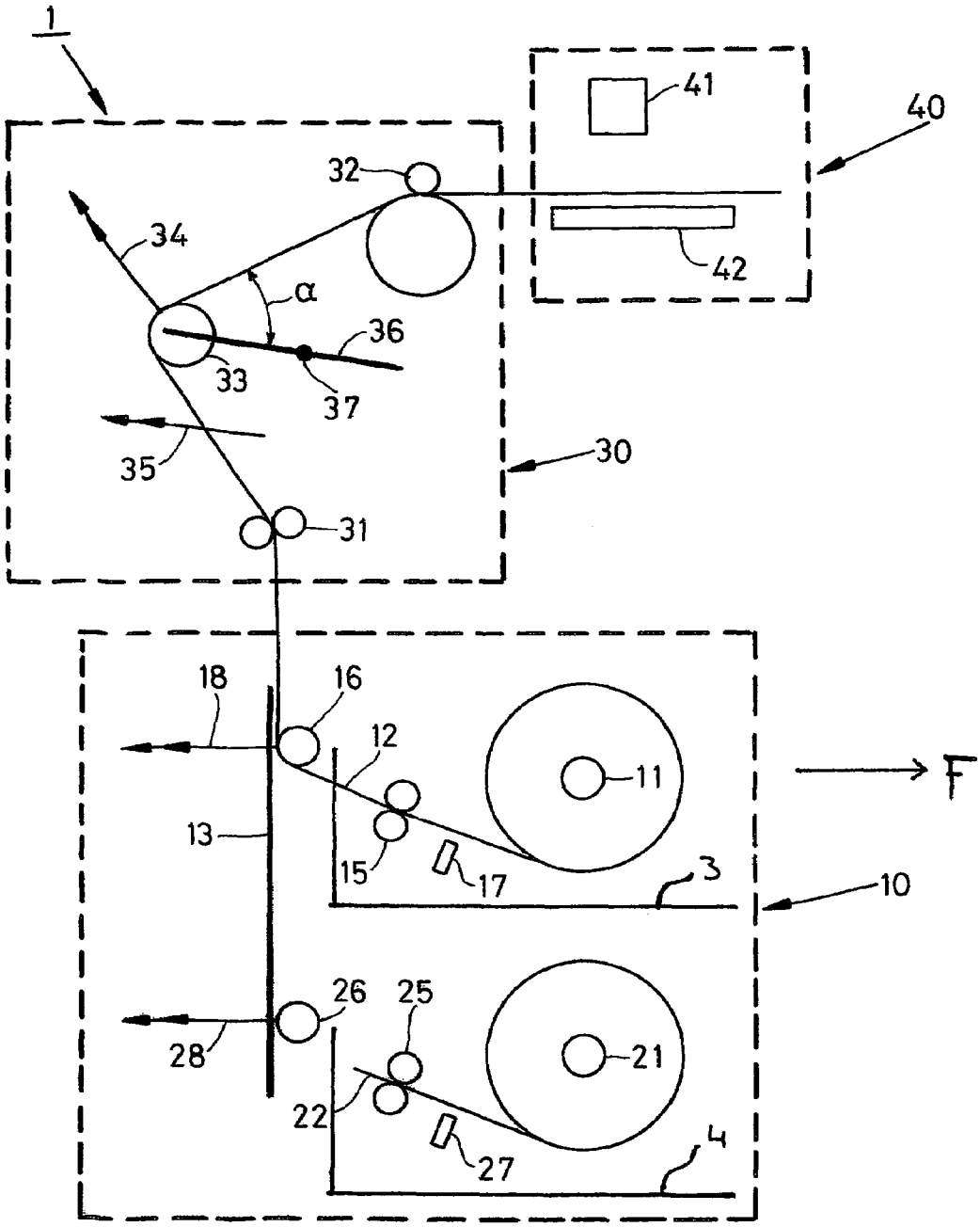
FIG. 1 is a diagram showing a printer according to the present invention.

FIG. 1 is a diagram showing a printer according to the present invention. The printer is provided with a supply unit 10 which serves for storage and delivery of the substrate for printing. In addition, the printer includes transport unit 30 which transports the substrate from the supply unit 10 to the print unit 40. Unit 30 also ensures accurate positioning of the substrate in the print zone formed between the print surface 42 and the inkjet printhead 41. In this embodiment, print unit 40 is a conventional engine comprising printhead 41 which is constructed from a number of loose sub-heads, each for one of the colors black, cyan, magenta and yellow. A printhead of this type is described in detail in European patent application EP 1,378,360. Printhead 41 has only a limited print range so that it is necessary to print the image on the substrate in various sub-images. For this purpose, the substrate is transported in increments in each case in the transit direction (subscan direction) so that a new part of the substrate can be printed in the print zone. In the example illustrated, the substrate 12 originates from core 11 containing a roll of substrate, which roll is situated in the supply unit 10. The roll is received in drawer 3 of the supply unit. A web of substrate is wound on the core 11 of the roll and has a length of 200 meters. To accommodate the roll in the printer the drawer 3 is provided with a holder (not shown) to support the core in the surroundings at its ends. As a result the roll can be rotatably accommodated in the drawer. The holder comprises two support members received in side plates of the drawer, the support members being brought into co-operative connection with the ends of the roll. In this embodiment the supply unit is provided with a second drawer 4 to receive a following roll containing a core 21 on which a substrate 22 is wound. The substrate 22 can also be delivered by the supply unit for printing. The drawers can be pushed out of the supply unit 10 in the indicated direction F for the withdrawal of the rolls and/or insertion of new rolls. For the transport of the substrate, core 11 is operatively connected to transport means 15, which in this case comprises a pair of rollers between which a transport nip is formed. A sensor 17 is mounted upstream of transport means 15 to determine whether there is still substrate on the roll in the relevant holder. The holder is provided with transport means 25 for the transport of a substrate originating from the other roll. Upstream of this means the supply holder is provided with sensor 27 which has the same action as sensor 17. The supply holder is provided with guide elements 16 and 26 to guide the substrates 12 and 22 respectively to the transport unit 30. Transit path 13 is located downstream of these guide elements. This transit path is used both for the transport of substrate 12 and the transport of substrate 22.

A substrate leaving the supply unit 10, substrate 12 in this example, is engaged by transport means 31 of the transport unit 30. The transport means 31 transports the substrate via a guide element 33 on to the second transport means 32 of the transport unit 30. The transport means 32 engages the substrate, and transports it on to the print unit 40. Thus the printer is configured to print substrate 12. For adapting a configuration to print substrate 22, it is necessary in this case to wind substrate 12 back on the core 11 so that the free end finally leaves transit path 13. Roller pair 15 then continues to hold the substrate 12 fast. Substrate 22 can then be spooled over guide element 26 by the drive of the roller pair 25 until nip 31 is reached whereupon the latter takes over the drive for the substrate and spools the substrate onto nip 32 for finally reaching the print surface 42. The printer is then configured to print substrate 22.

The guide elements 16 and 26 are, in this example, rollers extending parallel to the transport means 15 and 31; 25 and 31 respectively. They are basically stationary rollers (i.e., they cannot rotate about their axial axis). The guide elements are so disposed in the supply unit that they can each rotate, at least through a limited angle, about an axis. In the drawing, the rotational axis 18 of element 16 is shown, and also rotational axis 28 of element 26. These rotational axes are perpendicular to the axes of the guide elements and intersect the middle of these elements.

Guide element 33 of transport unit 30, which element extends substantially parallel to the transport means 31 and 32, is also disposed so that it can rotate about an axis perpendicular to the axial direction of the said element. The axis is shown by reference 34 and intersects the middle of guide element 33. Since element 33 in this embodiment is a co-rotating roller, the substrate remains substantially stationary with respect to the surface of this guide element. Element 33 is also suspended so that it can rotate about axis 35 which extends parallel to the bisector 36 of the angle $2\alpha$ over which the substrate is fed from transport means 31 to transport means 32. The axis 35 intersects the middle of the substrate web at a distance of about 1 meter from the guide element itself.

Guide element 33 is movable from a first position as it is situated in FIG. 1, to a second position in which the center of this element coincides with location 37. In the first position, the distance over which substrate 12 extends between transport means 31 and transport means 32 is at a maximum. In the second position this distance is minimal. Use is made of this during the transport of the substrate to print unit 40. Since the substrate must in each case be moved over a relatively small distance (typically 5 to 10 cm), it is advantageous for this to take place relatively rapidly. However, the mass inertia of roll 11, certainly when it is provided with a maximum quantity of substrate, is relatively high. For this reason, displacement while maintaining the configuration shown for the transport means and guide elements would take a considerable amount of time relatively speaking. To counteract this problem, transport means 31 is accelerated much more slowly than transport means 32. However, in order to ensure sufficient supply of substrate to transport means 32, the guide element 33 is moved in the direction of location 37.

Figure 2:
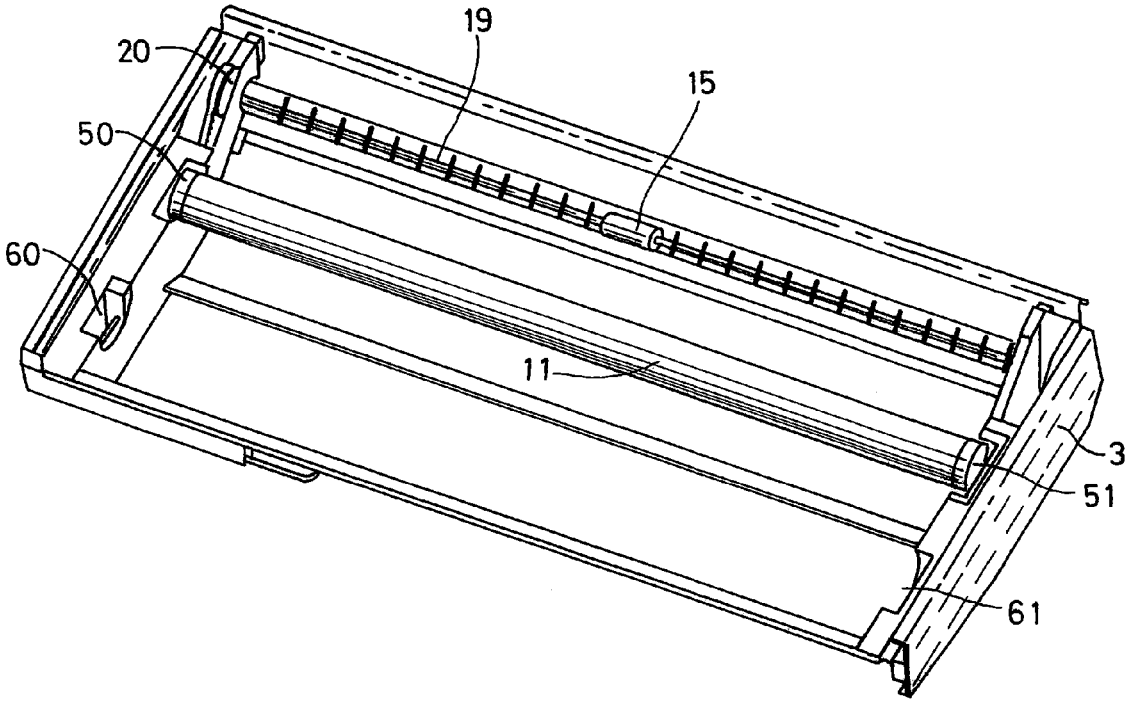
FIG. 2 is a diagram showing a drawer as a supply unit for the printer.

FIG. 2 diagrammatically illustrates an alternative embodiment of the drawer 3. In this case, the drawer is provided with two holders to receive two individual cores. The first holder contains a first pair of support members 50 and 51. The second holder includes a second pair of support members 60 and 61. In the drawing, the core 11 is received in the first holder. When this drawer is in use in a printer the core present therein will be provided with a substrate wound thereon (not shown). To unwind the substrate, the core is rotatably accommodated in the holder. Roller pair 15, of which only one roller is visible in the drawing, also forms part of the drawer. The roller illustrated is mounted on shaft 19 which can be driven by gearwheel 20.

The distance between the support members is such that a user can easily place a roll in the holder by bringing the core ends substantially to coincide with the positions of the two support members. After the roll has been placed in the holder, it is automatically brought by means of a number of resilient elements into a substantially fixed position with respect to the print surface. This is shown in greater detail in FIG. 3 and the accompanying description.

Figure 3:
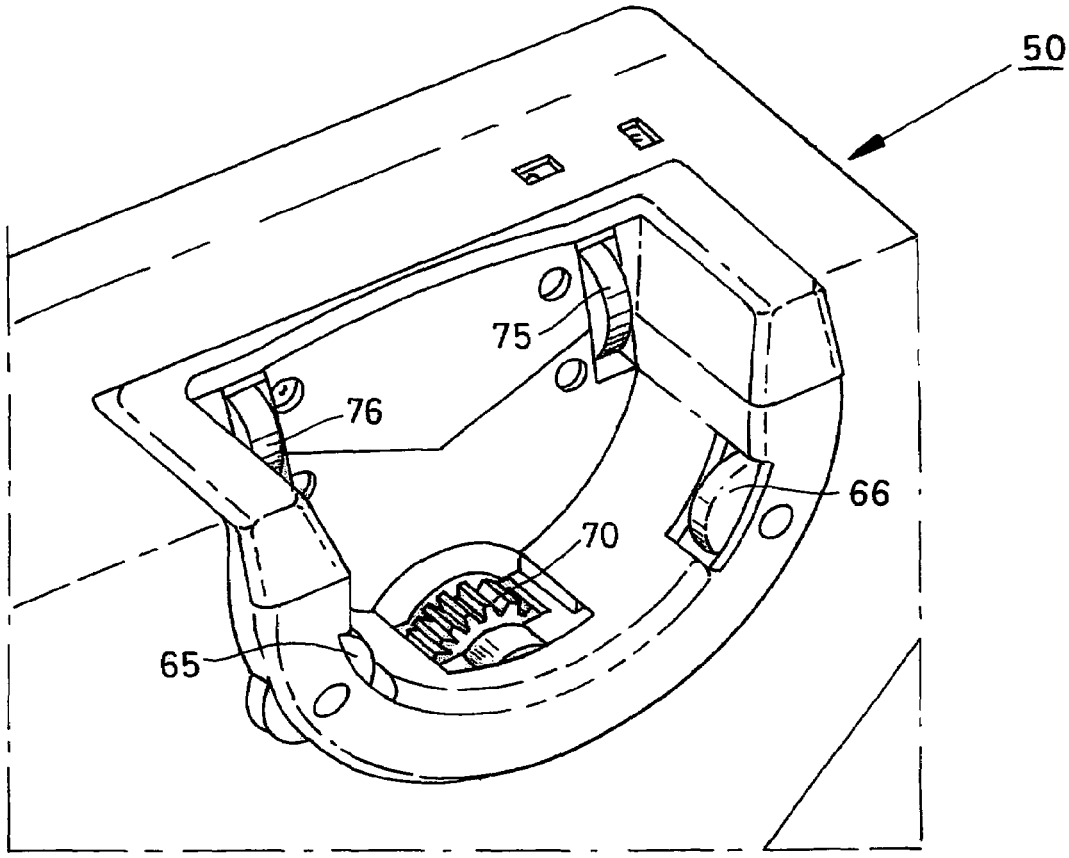
FIG. 3 diagrammatically illustrates a support member of a holder of the drawer.

FIG. 3 is a detail of the support member 50, the core 11 being omitted for the sake of clarity. Support member 50 includes two support rollers 65 and 66 which rotatably support the core. During the core rotation, either for the unwinding of the substrate or for winding it on the core, the core rotates over these rollers. The rollers are not driven under these conditions.

To drive the core, member 50 is provided with a gearwheel 70. The teeth of this gearwheel engage in an external toothing of the core. In this way, by driving the gearwheel 70, the core is forced to rotate. In the printer in accordance with the embodiment illustrated here, gearwheel 70 is only driven when the substrate has to be rewound on to the core, for example when the roll in question is to be replaced by a roll with a different substrate. During unwinding of the substrate, the core is driven passively: the roller pair 15, in this case, forms a transport nip and pulls on the substrate. As a result the core 11 will rotate and the substrate can be unwound from the core. Member 50 is also provided with two resiliently mounted wheels 75 and 76. These wheels are spaced apart an amount exactly equal to the diameter of the core. Upon the rotation of the core these wheels will co-rotate over the end edge of the core. The suspension of these wheels is such that they exert a force on the core in the axial direction so that it is pushed in the direction of support member 51. The latter member also includes two such wheels (not shown), although they are not resiliently suspended. These wheels therefore form a stop for the core. In addition, these wheels occupy substantially a fixed position with respect to the print surface 42. As a result, the core and hence the substrate thereon, will also be able to occupy a fixed position with respect to said print surface.

Figure 4:
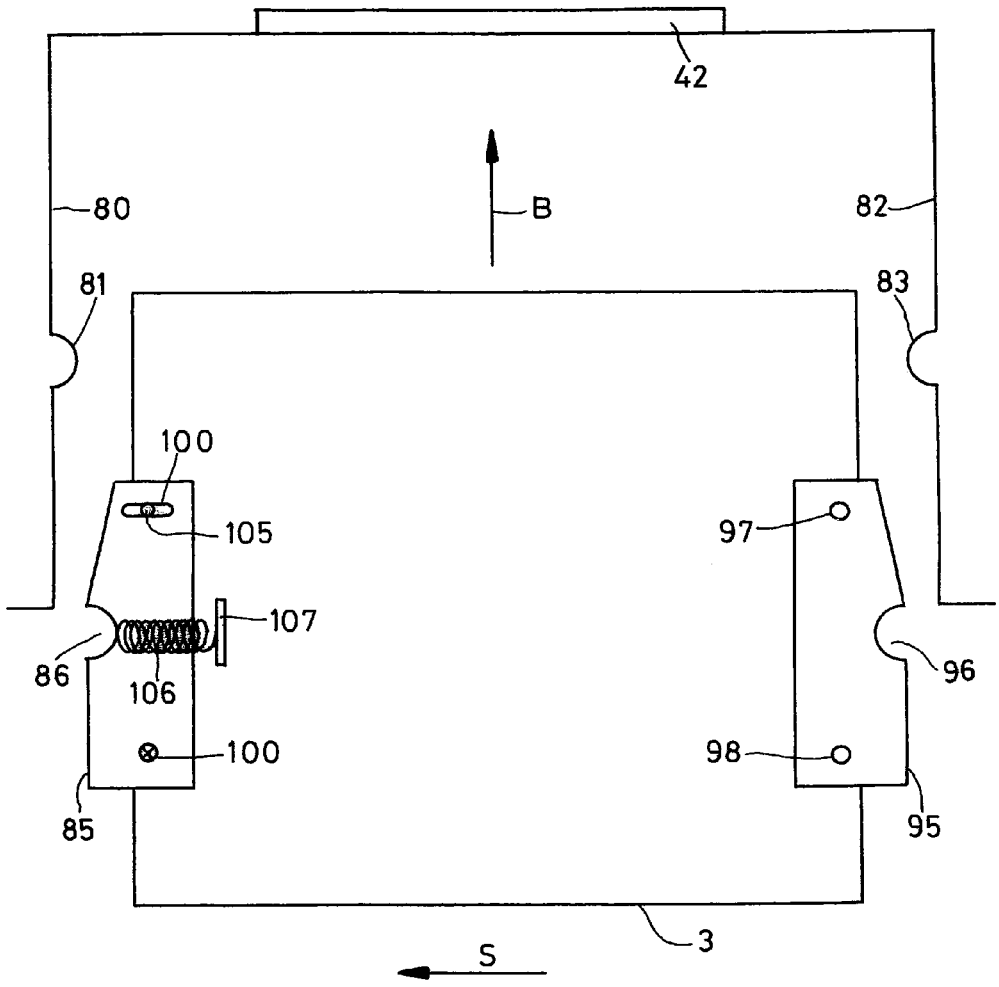
FIG. 4 is a diagram showing a drawer and the means for positioning it in the sub-scanning direction with respect to the print surface.

FIG. 4 diagrammatically shows a top plan view of a drawer 3 and a means for positioning it in the sub-scanning direction with respect to the print surface 42. Print surface 42 is connected to the printer frame, which frame in this case includes side panels 80 and 82. These panels are provided with projections 81 and 83, respectively. Drawer 3 is provided with two positioning elements 85 and 95. These elements are provided with indentations 86 and 96 respectively to co-operate with the projections 81 and 83, respectively. Element 95 is fixedly connected to drawer 3 by the use of connecting elements 97 and 98. Element 95 is movably connected with respect to the drawer 3. For this purpose a rotational spindle 100 is provided which is mounted on the drawer and which is rotatably enclosed by a hole in element 85 coinciding with said spindle. On the other side, element 85 is provided with a slot 100 which accommodates a spindle 105 fixed on the drawer. This embodiment makes it possible for element 85 to rotate, at least through a small angle, about spindle 100. At the indentation 86 the element is provided with a spring 106 which is fixed against an upright edge 107 of the drawer 3. In this way the element is pushed in the indicated direction S.

When the drawer is pushed inwards in the indicated direction B (which is the opposite direction to the direction F shown in FIG. 1), element 85 will be forced, in the opposite direction to S, as soon as element 85 comes into contact with projection 81. On further insertion of the drawer in the direction B element 85 will be increasingly forced further in this direction. As soon as the position of the projections 81 and 83 coincides with that of the indentations 86 and 96, however, element 85 will be pushed in the direction S under the influence of spring 106. As a result, the drawer 3 will be pushed in the direction of side panel 82 so that the drawer will occupy substantially a fixed position with respect to the print surface 42.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer which comprises a printhead which is displaceable at the level of a print surface in a main scanning direction and in a sub-scanning direction with respect to a substrate situated on the print surface, and a supply unit for storing the substrate which is disposed on a core and delivering the substrate for transport to the print surface, said supply unit including support means for supporting the core at its end portions so that the core, while being supported can rotate with the unwinding of the substrate from the core said support means containing two elements for exerting a force on the core in the axial direction during the rotation thereof, whereby the core is pressed against a stop which occupies a substantially fixed position in the axial direction with respect to the print surface.

2. The printer according to claim 1, wherein the elements are resilient in the axial direction.

3. The printer according to claim 1, wherein the support means includes a first and second support member wherein the stop is a part of the second support member.

4. The printer according to claim 1, wherein two elements are spaced apart by an amount substantially equal to the diameter of the core.

5. The printer according to claim 4, wherein the elements are resiliently mounted on wheels.

6. The printer according to claim 1, wherein the supply unit comprises a drawer in which the support means are received and another element for exerting force on the drawer in a direction parallel to the core, wherein the drawer is pressed against a stop which occupies a substantially fixed position with respect to the print surface.

7. The printer according to claim 6, wherein the drawer is equipped for simultaneously holding two cores, each provided with a substrate disposed thereon.

8. The printer according to claim 1, wherein the core is provided with an external toothing in the vicinity of one end of said core and the supply unit is provided with a driveable gearwheel adapted to engage said toothing when the core is supported therein.

9. The printer according to claim 1, wherein said printer is an inkjet printer.

* * * * *